US008534101B2

(12) United States Patent
Mette et al.

(10) Patent No.: US 8,534,101 B2
(45) Date of Patent: Sep. 17, 2013

(54) ELECTRONIC UNLATCH SYSTEM FOR VEHICLE DOOR

(75) Inventors: Richard K. Mette, Shelby Township, MI (US); David M. Trush, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 289 days.

(21) Appl. No.: 12/709,589

(22) Filed: Feb. 22, 2010

(65) Prior Publication Data

US 2011/0203336 A1 Aug. 25, 2011

(51) Int. Cl.
*E05B 47/00* (2006.01)
*E05B 65/20* (2006.01)

(52) U.S. Cl.
USPC ..... 70/277; 307/10.1; 307/10.2

(58) Field of Classification Search
USPC ..... 307/10.1, 10.2
See application file for complete search history.

(56) References Cited

U.S. PATENT DOCUMENTS 5,596,234 A * 1/1997 Umeda et al. ..... 307/10.2
5,715,713 A * 2/1998 Aubry et al. ..... 70/277
6,038,895 A * 3/2000 Menke et al. ..... 70/278.1
6,354,120 B1 * 3/2002 Tan et al. ..... 70/252
7,642,669 B2 * 1/2010 Spurr ..... 307/9.1
7,791,218 B2 * 9/2010 Mekky et al. ..... 307/10.1
2006/0012217 A1 * 1/2006 Cantu ..... 296/146.7
2007/0145821 A1 6/2007 Mekkey et al.
2010/0007463 A1 * 1/2010 Dingman et al. ..... 340/5.72

FOREIGN PATENT DOCUMENTS

DE 19724085 C1 10/1998
DE 10004616 A1 8/2001
DE 60106993 T2 3/2006
JP 200064685 * 2/2000

* cited by examiner

*Primary Examiner* — Rexford Barnie
*Assistant Examiner* — Toan Vu

(57) ABSTRACT

A vehicle door having an electronic unlatch system and a method of operation. The door includes an electronic key cylinder mounted to the door and includes a slot that receives a key; a switch engaging the key cylinder to detect when a key has been turned in the cylinder; and a door latch mounted to the door to selectively unlatch the door, with the door latch receiving a signal from the switch to unlatch the door. The door also includes a backup power supply mounted in the door and supplying electrical power to the door latch and switch, with the backup power supply receiving power from a vehicle electrical system to recharge the backup power supply.

5 Claims, 2 Drawing Sheets

ELECTRONIC UNLATCH SYSTEM FOR VEHICLE DOOR

BACKGROUND OF INVENTION

The present invention relates generally to vehicle doors and more particularly to key and latch systems for access from the outside of a vehicle door.

Some automotive vehicles now employ electronic door systems where the door handle is electronically linked to the door latch, rather than mechanically linked. Thus, an electronic latch is employed that is powered by the vehicle electrical system and electronically controls the unlatching of the door. With the conventional mechanical linkages driven by movement of the door handle eliminated, a backup system is needed to allow for door opening when the main power from the vehicle electrical system is interrupted. These backup systems typically involve running a cable, attached to an emergency release on the latch, to a cargo area, such as a trunk. Then, if the main vehicle power is interrupted, one can open the trunk and pull on the cable to mechanically cause the latch to open. However, all of the extra cable and linkages are undesirable.

SUMMARY OF INVENTION

An embodiment contemplates a vehicle door having an electronic unlatch system. The door includes an electronic key cylinder mounted to the door and including a slot configured to receive a key; a switch operatively engaging the electronic key cylinder to detect when a key has been turned in the key cylinder; and a door latch mounted to the door and configured to selectively unlatch the door, with the door latch configured to receive a signal from the switch to unlatch the door. The door also includes a backup power supply mounted in the door and configured to supply electrical power to the door latch and switch, with the backup power supply configured to receive power from a vehicle electrical system to recharge the backup power supply.

An embodiment contemplates a method of unlatching a vehicle door having an electronic unlatch system, the method comprising the steps of: charging a backup power supply, mounted in the door, with a vehicle electrical system; activating a switch by inserting and turning a key in an electronic key cylinder in the door; sending a signal from the switch to a door latch requesting unlatching of the door; and using power from the backup power supply to power the door latch to unlatch the door.

An advantage of an embodiment is that the electronic unlatch system allows for unlocking and opening a vehicle side door without the use of a mechanical backup system, even when the main vehicle power is interrupted. This allows elimination of a mechanical backup system, which may allow for a reduction in the number of components, simplify vehicle assembly, save weight and improve vehicle packaging. Also, the operation of a key in the electronic unlatch system allows for both unlocking and unlatching the door when the vehicle power is interrupted, thus allowing one to enter the vehicle through the side door during power interruptions.

DETAILED DESCRIPTION

Figure 1:
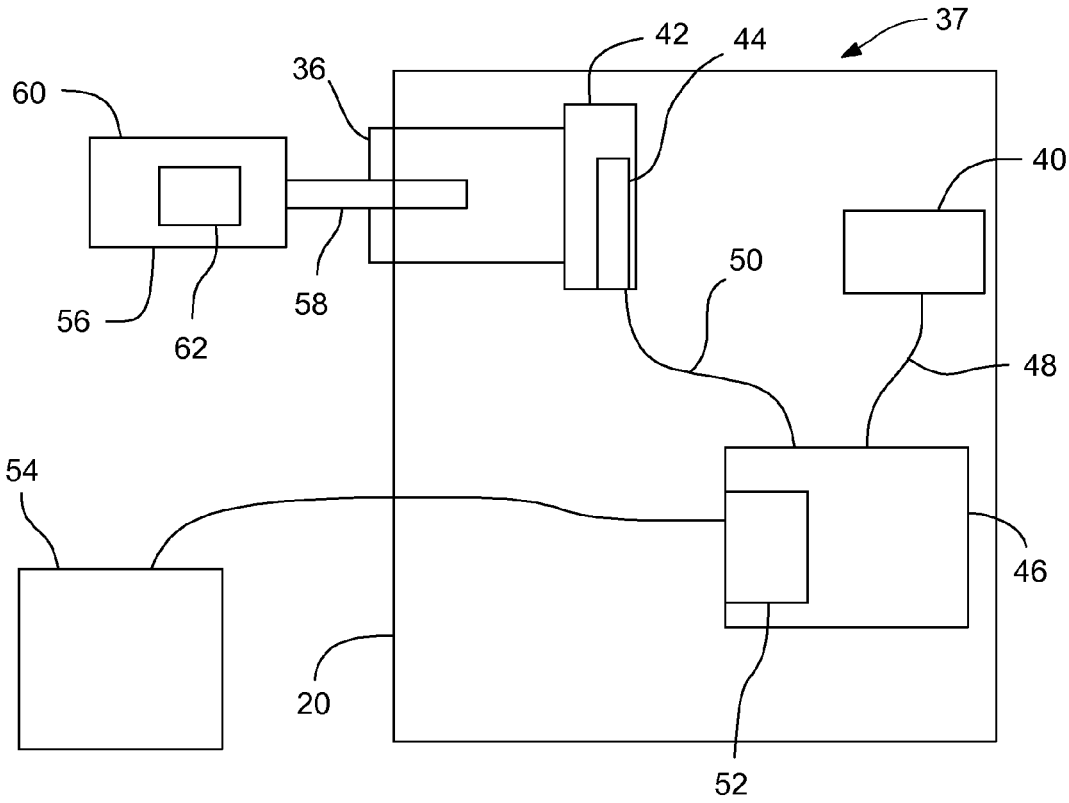
FIG. 1 is a schematic diagram of a portion of an electronic unlock system in a vehicle.
Figure 2:
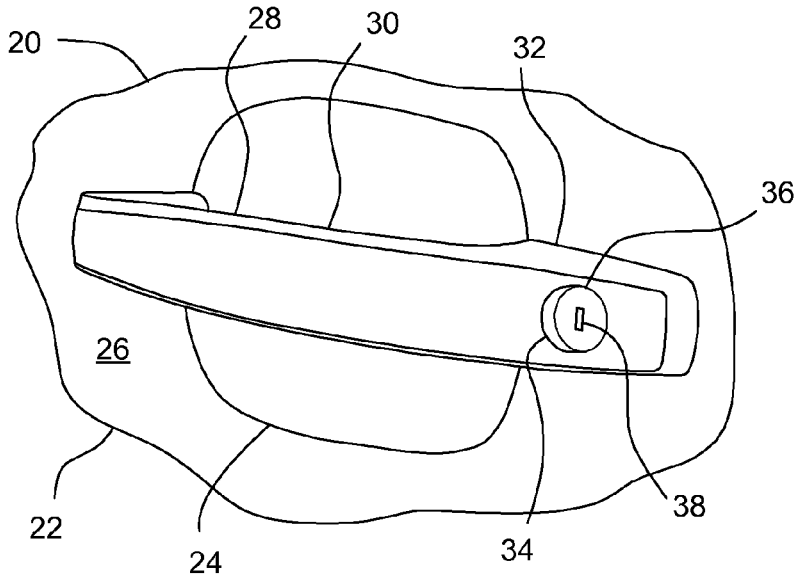
FIG. 2 is a perspective view of an outside door handle mounted on a vehicle door.
Figure 3:
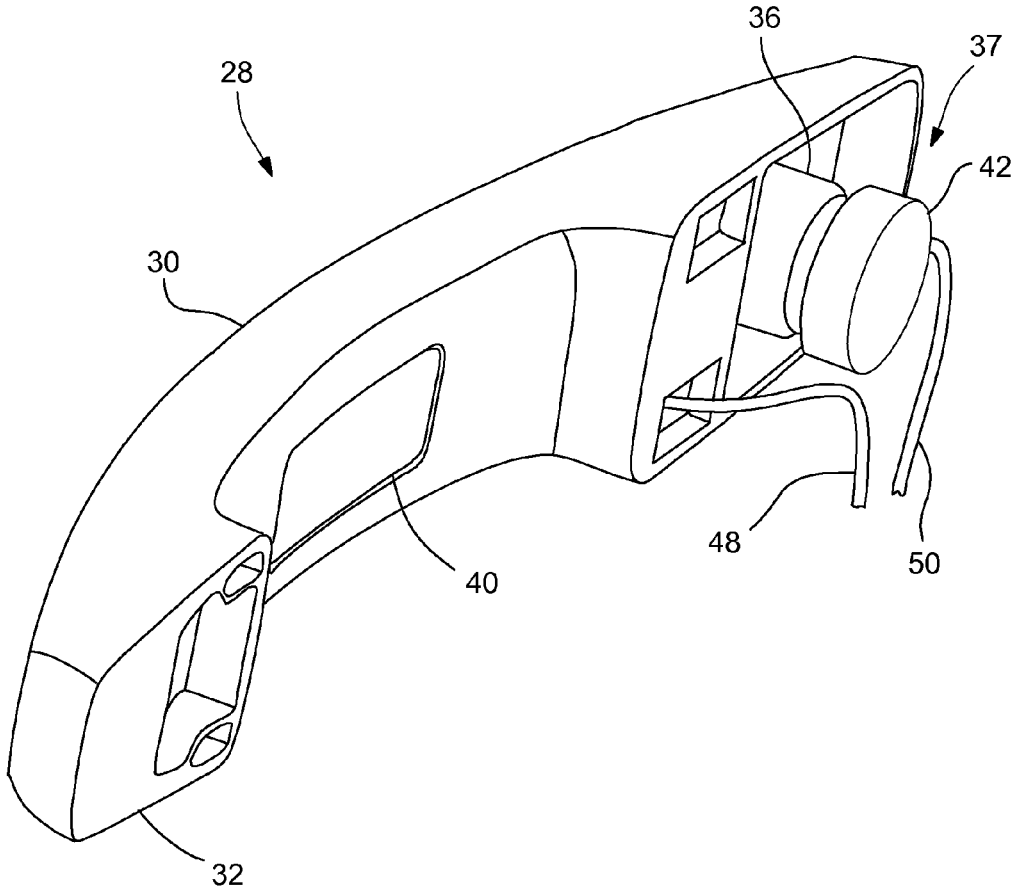
FIG. 3 is a perspective view of the outside door handle showing the side that mounts to the vehicle door.

Referring to FIGS. 1-3, a portion of a vehicle door 20 is shown. This may be, for example, a driver's side door. The vehicle door 20 includes a door outer panel 22 having a handle depression 24 creating a recess in an outer surface 26 of the outer panel 22. An outside door handle 28 mounts to the door 20 adjacent to the handle depression 24.

The outside door handle 28 has a hand grip portion 30 extending between a pair of door mounting portions 32. A touch pad 40 is exposed on an inside surface of the hand grip portion 30. Touch pad wiring 48 connects the touch pad to a door latch 46 that can be electronically actuated to unlatch the door 20, allowing the door 20 to open. A bore 34 for receiving an electronic key cylinder 36 extends through one of the mounting portions 32. The electronic key cylinder 36 mounts in and includes a key slot 38 that is accessible from the outside of the vehicle through the bore 34. A key 56 includes a blade portion 58 that fits within the key slot 38 and a key head portion 60 that includes electronics 62 embedded within it.

The electronic key cylinder 36 is part of an electronic unlatch system 37 and is attached to a switch 42 having verification electronics 44 therein that allow for verification, encryption and transmission of a signal from the switch 42 to the door latch 46 via key cylinder wiring 50. The electronics 44, 62 may be any combination of hardware and software and electronics for performing such functions and is known to those skilled in the art.

The signal from the switch 42 can cause the latch 46 to unlatch the door 20. The latch 46 includes a backup power supply 52 that may be mounted within, mounted on or mounted adjacent to the latch 46 in the door 20. The backup power supply 52 may be a rechargeable battery, a capacitor or other type of power storing device. The latch 46 and the backup power supply 52 are powered from the vehicle electrical system 54, which may include a vehicle battery, alternator, etc., as is known to those skilled in the art. In the case of the latch 46, the electrical system 54 provides power to operate the latch 46 and touch pad 46 during normal vehicle operation. In the case of the backup power supply 52, the electrical system 54 provides power to charge the power supply 52 during normal vehicle operation so that stored energy is available should electrical system power be lost.

The operation of the electronic unlatch system 37 will now be discussed. Under normal operating conditions, a person contacting the touch pad 40 will send a signal to unlatch the door latch 46 if the door is unlocked. The power for the touch pad 40 and door latch 46 is supplied by the vehicle electrical system 54. Unlocking the door under normal operating conditions can be initiated by a key fob (not shown) or other known means for unlocking the door. Also, under normal operating conditions, the backup power supply 52 recharges with power taken from the vehicle electrical system 54, thus remaining charged at all times.

There may be times, however, when the side door 20 is locked and closed and the power from the vehicle electrical system 54 is interrupted. This may occur, for example, when the vehicle battery is dead and the vehicle is off. In this situation, the key fob (or other unlocking) system and the door latch 46 can no longer be powered by the vehicle electrical system 54. One then inserts an appropriate key 56 in the key slot 38 and attempts to turn it. The key cylinder 36 allows it to turn if the teeth on the key blade 58 match the key cylinder 36. This rotation closes the switch 42, which activates the verification electronics 44. The verification electronics 44 is powered by the backup power supply 52 in the door latch 46. The verification electronics 44 initiates a wireless challenge/response verify operation with the electronics 62 in the key head 60 to determine if the key 56 is approved for unlocking the door 20. Once the key 56 is verified, the verification electronics 44 sends an encrypted signal to the door latch 46 to unlock and unlatch the door 20. The door latch 46, receiving power from the backup power supply 52, will unlock and unlatch the door 20. Thus, one will be able to enter the vehicle, even when the main power of the vehicle electrical system 54 is not available.

While certain embodiments of the present invention have been described in detail, those familiar with the art to which this invention relates will recognize various alternative designs and embodiments for practicing the invention as defined by the following claims.

What is claimed is:

1. A method of unlatching a vehicle door having an electronic unlatch system, the method comprising the steps of:

(a) charging a backup power supply, mounted in the door, with a vehicle electrical system;

(b) when electrical power from the vehicle electrical system has been interrupted, activating an electronic switch mounted to the electronic key cylinder by inserting and turning a key in an electronic key cylinder in the door;

(c) upon completing step (b), sending an electronic signal from the electronic switch to a door latch requesting unlatching of the door; and (d) upon completing step (c), using power from the backup power supply to power the door latch to unlatch the door when power from the vehicle electrical system is unavailable.

2. The method of claim 1 wherein step (a) is further defined by the backup power supply being a rechargeable battery that is recharged by the vehicle electrical system.

3. The method of claim 1 wherein step (a) is further defined by the backup power supply being a capacitor that is charged by the vehicle electrical system.

4. The method of claim 1 wherein step (c) is further defined by the signal being encrypted before being sent to the door latch.

5. The method of claim 1 wherein step (c) is further defined by employing verification electronics in the electronic switch to verify that the key inserted into the electronic key cylinder is approved for unlocking the door prior to sending the signal.

* * * * *